US007213346B1

(12) United States Patent
Gregory

(10) Patent No.: US 7,213,346 B1
(45) Date of Patent: May 8, 2007

(54) INSTALLATION TOOL FOR HORIZONTAL SIDING BOARDS

(76) Inventor: Catherine A. Gregory, 94295 Mill Stream Rd., Gold Beach, OR (US) 97444

( * ) Notice: Subject to any disclaimer, the term of this patent is extended or adjusted under 35 U.S.C. 154(b) by 0 days.

(21) Appl. No.: 11/355,125

(22) Filed: Feb. 15, 2006

(51) Int. Cl.
*G01D 21/00* (2006.01)

(52) U.S. Cl. ..... 33/647; 33/613

(58) Field of Classification Search ..... 33/519, 33/613, 645, 646, 647, 648, 649
See application file for complete search history.

(56) References Cited

U.S. PATENT DOCUMENTS 1,750,854 A * 3/1930 Nelson ..... 33/649
3,490,152 A * 1/1970 Printz ..... 33/649
4,484,392 A 11/1984 DeFino et al.
5,623,767 A 4/1997 Colavito
2004/0221467 A1* 11/2004 Chillington ..... 33/649

* cited by examiner

*Primary Examiner*—G. Bradley Bennett
(74) *Attorney, Agent, or Firm*—David S. Alavi

(57) ABSTRACT

An apparatus for installing siding boards comprises a body member, a siding-engagement member; and a cam member rotatably engaged with the body member. The cam member includes an eccentrically curved cam segment. The body member, siding-engagement member, and cam segment enable adjustment of vertical overlap of siding boards during installation with one of the boards engaged with the siding-engagement member and another board engaged against the eccentrically curved cam segment. A method for installing siding comprises engaging a pair of siding installation tools with an installed first siding board; positioning a second siding board against the eccentrically curved cam segments; adjusting vertical overlap of the boards by rotation of the cam members; securing the second board to an installation surface; rotating the cam members to disengage the cam segments from the second board; and disengaging and removing the installation tools from the first board.

24 Claims, 8 Drawing Sheets

104
102
106
108a
108

INSTALLATION TOOL FOR HORIZONTAL SIDING BOARDS

BACKGROUND

The field of the present invention relates to apparatus and methods for aligning and installing horizontal siding boards.

Several tools for installing horizontal siding boards are presently available. Two of these are described in:

U.S. Pat. No. 4,484,392 entitled "Method and means of installing siding" issued Nov. 27, 1984 to DeFino et al; and U.S. Pat. No. 5,623,767 entitled "Siding installation alignment tool" issued Apr. 29, 1997 to Colavito.

The apparatus and methods disclosed herein may provide functionality not provided by these previous tools, or may remedy deficiencies exhibited by these previous tools.

SUMMARY

An apparatus for installing siding boards comprises: a flattened central body member; a siding-engagement member at a first end of the body member; and a cam member rotatably engaged with the body member. The cam member rotates about a rotation axis substantially perpendicular to the flattened body member, and comprises a grip segment and a cam segment positioned between the body member and the grip segment. The body member and the siding-engagement member are arranged for engaging the top edge of a substantially horizontal installed first siding board with the body member against the front surface of the board and with the rotation axis substantially perpendicular to the front surface of the board. The cam segment has a cross-sectional profile comprising an eccentrically curved engagement portion and a disengagement portion. The cam segment is sufficiently thick so as to enable an edge of a siding board to be received between the body member and the grip segment against the cam segment. The grip segment extends radially from the rotation axis by a distance exceeding the maximum radial distance between the eccentrically curved engagement portion of the cam segment and the rotation axis so as to retain a siding board received between the body member and the grip segment. The body member, the siding-engagement member, and the cam segment are arranged for enabling adjustment over a range of vertical overlap of the engaged top edge of the first board by a bottom edge of a second siding board received between the body member and the grip segment by rotation of the cam member among a plurality of rotational positions with the bottom edge of the second board engaged against the eccentrically curved engagement portion of the cam segment. The body member, the siding-engagement member, and the cam segment are arranged for enabling disengagement of the cam segment from the second board by rotation of the cam member so that the disengagement portion of the cam segment faces upward toward the bottom edge of the second board.

A method for installing siding comprises: engaging a first siding installation tool with the top edge of a substantially horizontal installed first siding board; engaging a second siding installation tool with the top edge of the first board at a position horizontally displaced from the engaged first installation tool; positioning a second siding board with its bottom edge received between the body member and the correspond grip segment of the installation tools with the bottom edge against the eccentrically curved engagement portions of the corresponding cam segments of the cam members of the installation tools; adjusting vertical overlap of the engaged top edge of the first board by the received bottom edge of the second board by rotating of the cam members of the installation tools; securing the second board to an installation surface; rotating the cam members of the installation tools so that corresponding disengagement portions of the cam segments face upward toward the bottom edge of the second board, thereby disengaging the cam segments from the second board; and disengaging and removing the installation tools from the first board.

Objects and advantages pertaining to siding installation and tools therefor may become apparent upon referring to the exemplary embodiments illustrated in the drawings and disclosed in the following written description and/or claims.

Figure 1:
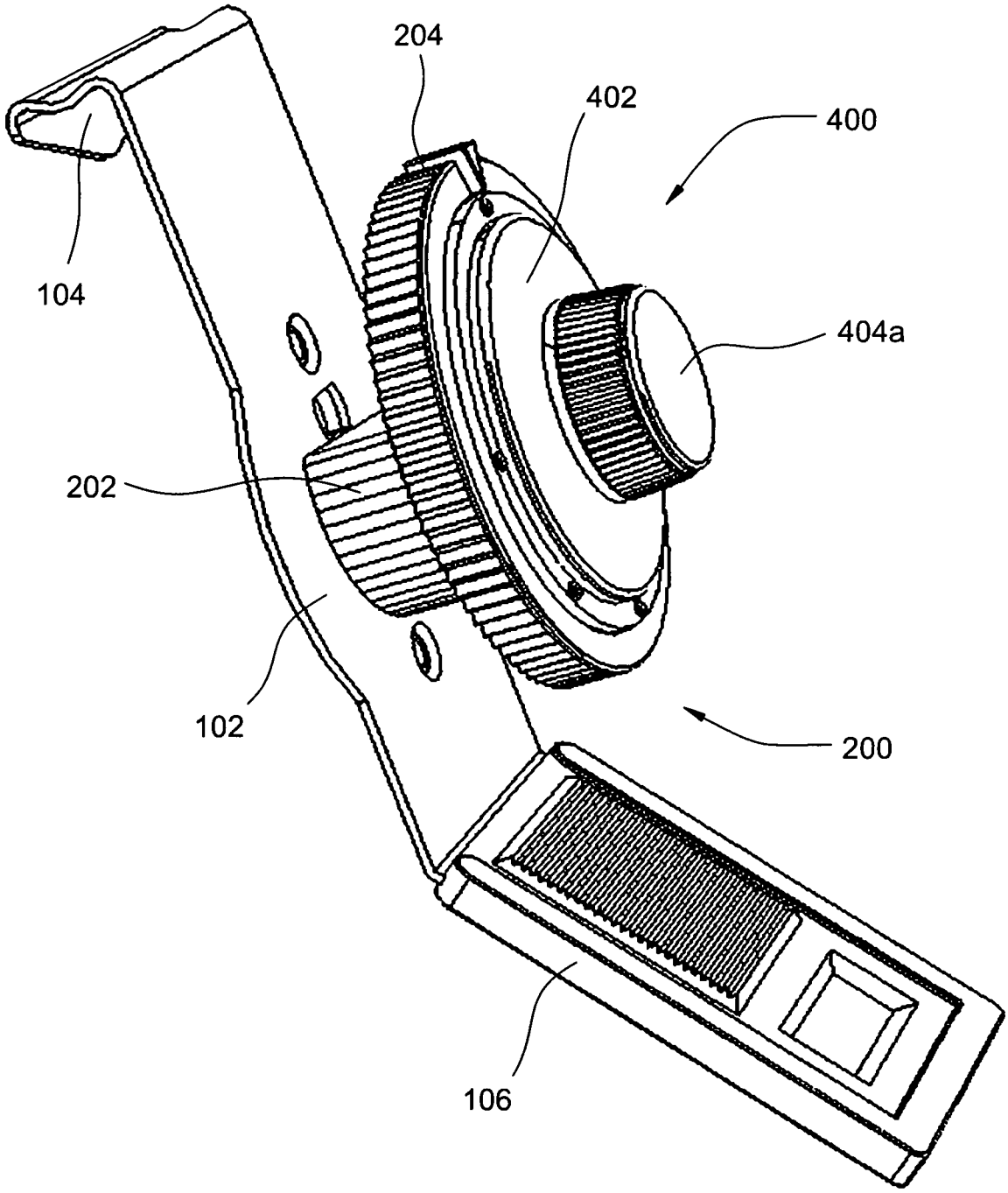
FIG. 1 is a perspective view of an exemplary installation tool for horizontal siding boards.

The embodiments shown and described in the drawings and description are exemplary and should not be construed as limiting the scope of the present disclosure or appended claims. Distances, sizes, thicknesses, proportions, and so forth may be distorted for clarity and shall not be construed as limiting the scope of the present disclosure or appended claims.

DETAILED DESCRIPTION OF EMBODIMENTS

Figure 2:
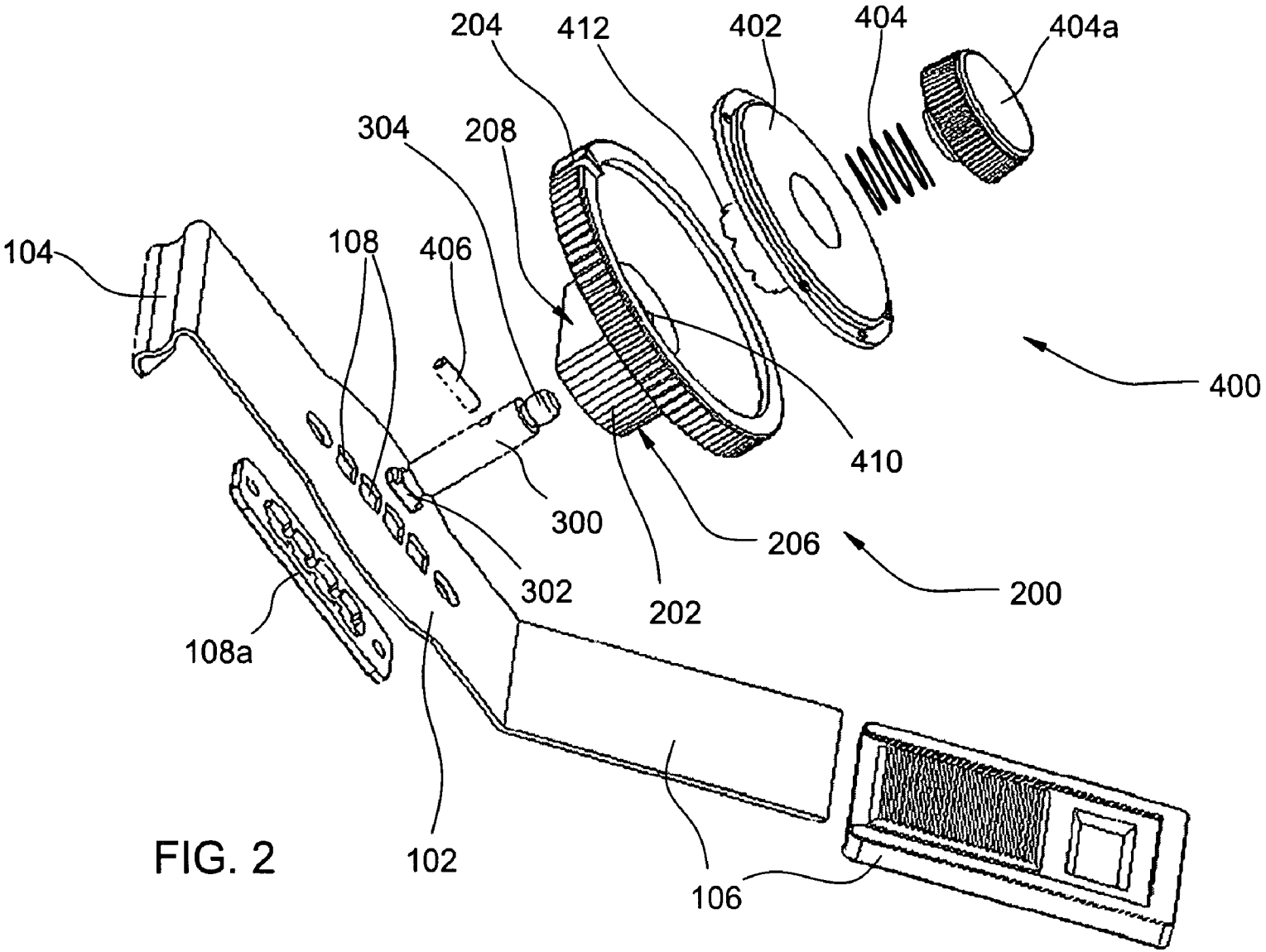
FIG. 2 is a perspective exploded view of the exemplary installation tool.

As shown in FIGS. 1 and 2, an apparatus for installing siding boards comprises: a flattened central body member 102; a siding-engagement member 104 at a first end of the body member 102; and a cam member 200 rotatably engaged with the body member 102 so as to rotate about a rotation axis substantially perpendicular to the flattened body member 102. The cam member 200 comprises a grip segment 204 and a cam segment 202, with the cam segment 202 positioned between the body member 102 and the grip segment 204.

Figure 9:
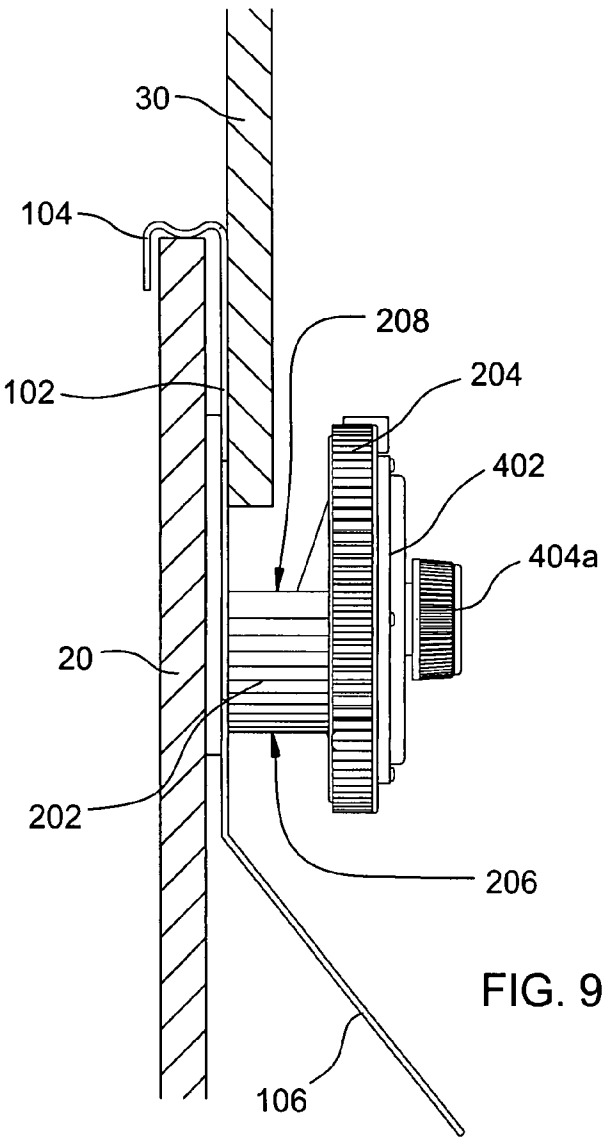
FIG. 9 is a side view of the exemplary installation tool engaged with a lower siding board and disengaged from an overlapping upper siding board.
Figure 8:
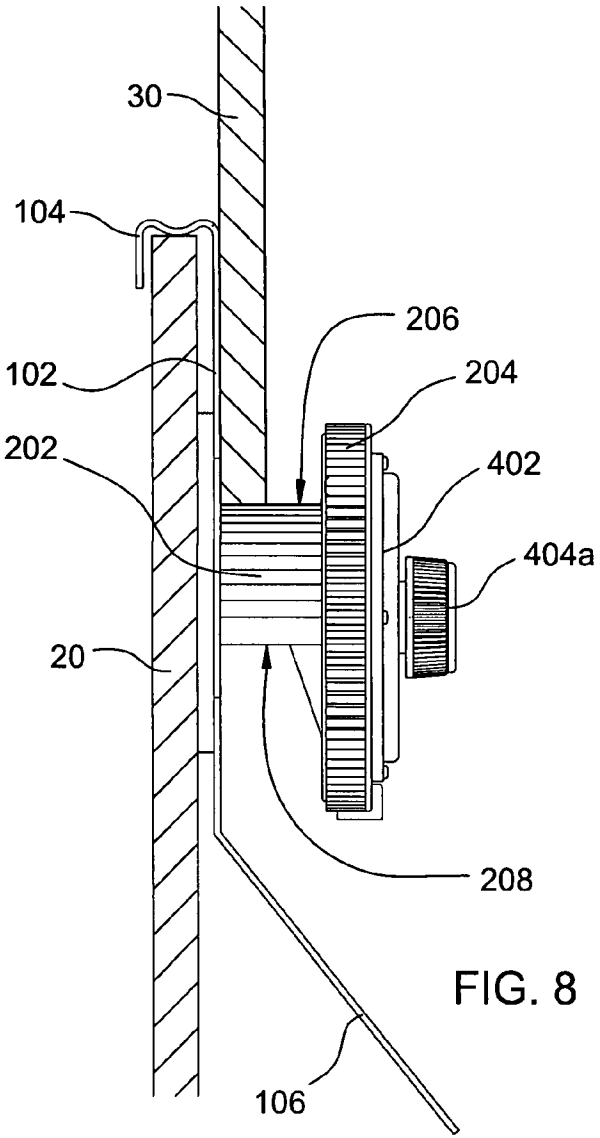
FIG. 8 is a side view of the exemplary installation tool engaged with overlapping upper and lower siding boards.

The body member 102 and the siding-engagement member 104 (shown in detail in FIGS. 5A–5E) are arranged for engaging a top edge of a substantially horizontal installed first siding board 20 as shown in FIGS. 8 and 9. When thus engaged, the body member 102 is positioned against front surface of the board 20 and with the rotation axis substantially perpendicular to the front surface of the board 20. The apparatus may include a handle member 106 or any other suitable handle means at the second end of the body member 102.

Figures 5A, 5B, 5C, 5D, 5E:
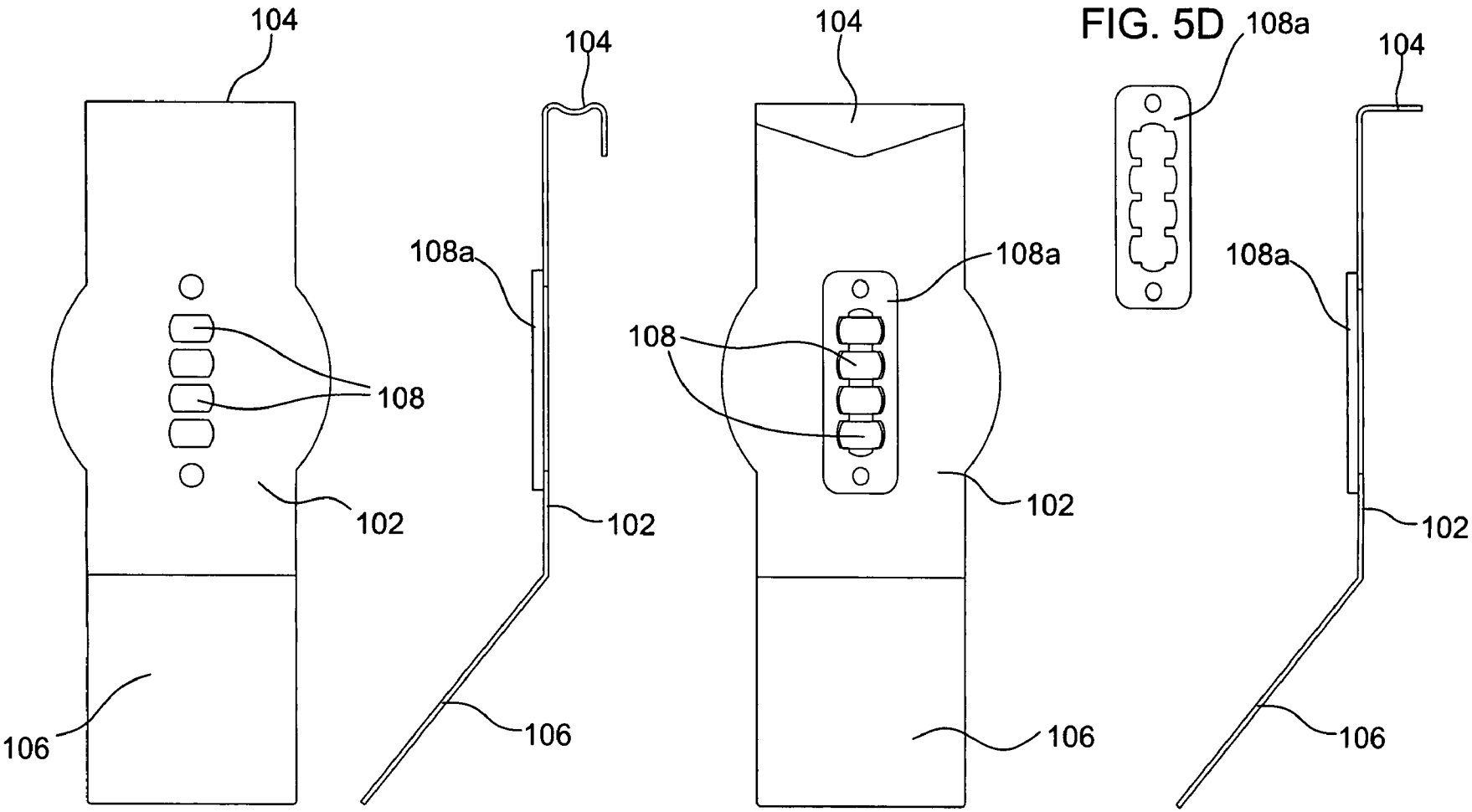
FIGS. 5A–5C are front, side, and back views, respectively, of a central body member and siding-engagement member of the exemplary installation tool.
FIG. 5D is a back view of a retaining plate.
FIG. 5E is a side view of the central body member and an alternative siding-engagement member.
Figure 7B:
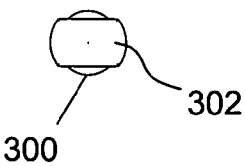
FIGS. 7A–7C are side, back, and bottom views, respectively, of a pin for the exemplary installation tool.
Figure 7C:
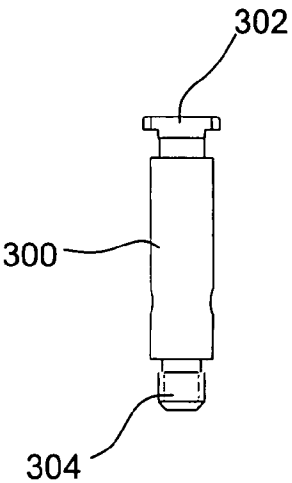
Figure 7A:
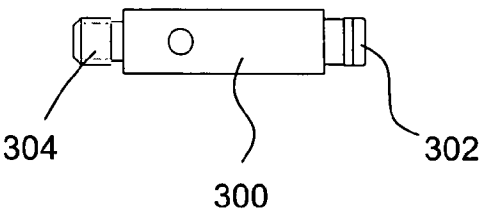

The siding-engagement member 104 may comprise a hook formed at the first end of the body member, the hook comprising a J-shaped hook (FIGS. 5A–5C) or an L-shaped hook (FIG. 5E). Any other suitable means may be employed for engaging the top edge of the board 20 with body member 102 against the front surface of the board and with the rotation axis substantially perpendicular to the front surface of the first board. In one exemplary embodiment (FIGS. 5A–5C), the siding-engagement member 104 comprises a J-shaped hook, with the downward-projecting portion of the J-shaped hooked comprising an oblique isosceles triangular plate for facilitating disengagement of the installation apparatus from the top edge of the first board by tilting the body member sideways. Any other suitable means may be employed for enabling or facilitating disengagement of the installation apparatus from the top edge of the board, by tilting sideways, tilting outward, sliding upward, or by other suitable movements of the installation tool.

Figure 4D:
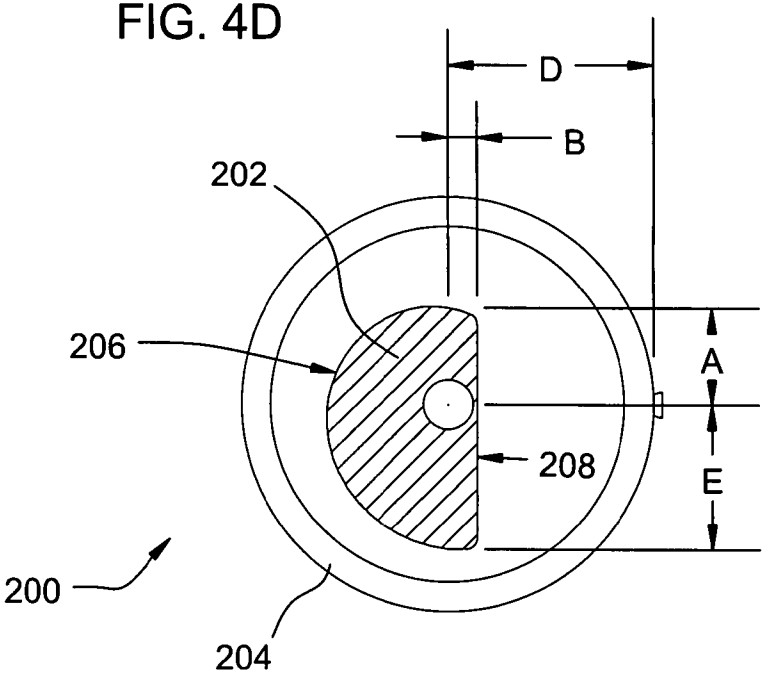
FIGS. 4A–4D are front, side cross-sectional, side, and back cross-sectional views, respectively, of a cam member of the exemplary installation tool.
Figure 4C:
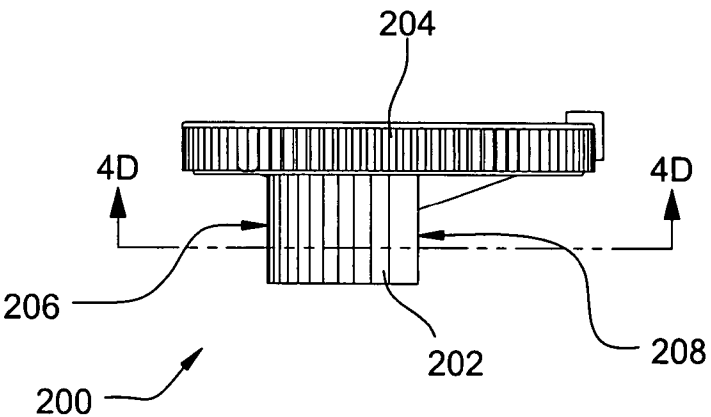
Figure 4A:
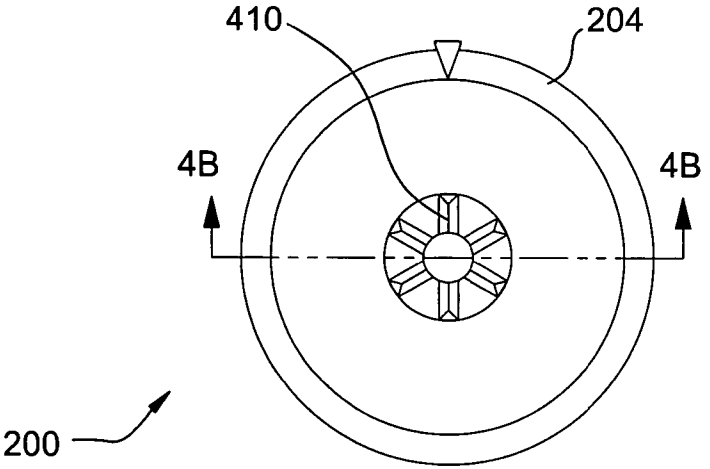
Figure 4B:
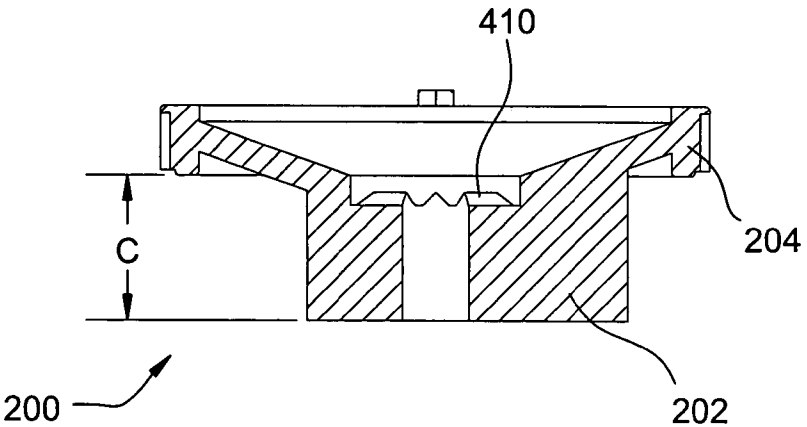

The cam member 200 is shown in detail in FIGS. 4A–4D. The cam segment 202 has a cross-sectional profile comprising an eccentrically curved engagement portion 206 and a disengagement portion 208 (FIG. 4D). The cam segment 202 is sufficiently thick (distance labeled C in FIG. 4B) so as to enable a siding board 30 to be received between the body member 102 and the grip segment 204 with a lower edge of the board 30 against the cam segment 202 (as shown in FIG. 8). Any other suitable means may be employed for receiving the edge of the siding board 30 between the body member 102 and the grip segment 204. The grip segment 204 extends radially from the rotation axis by a distance (labeled D in FIG. 4D) exceeding the maximum radial distance (labeled E in FIG. 4D) between the rotation axis and the eccentrically curved engagement portion 206 of the cam segment 202 so as to retain the siding board 30 received between the body member 102 and the grip segment 204 (i.e. for preventing the received board 30 from simply sliding off of the cam segment 202). Any other suitable means may be employed for retaining the siding board 30 received between the body member 102 and the grip segment 204.

Figure 3B:
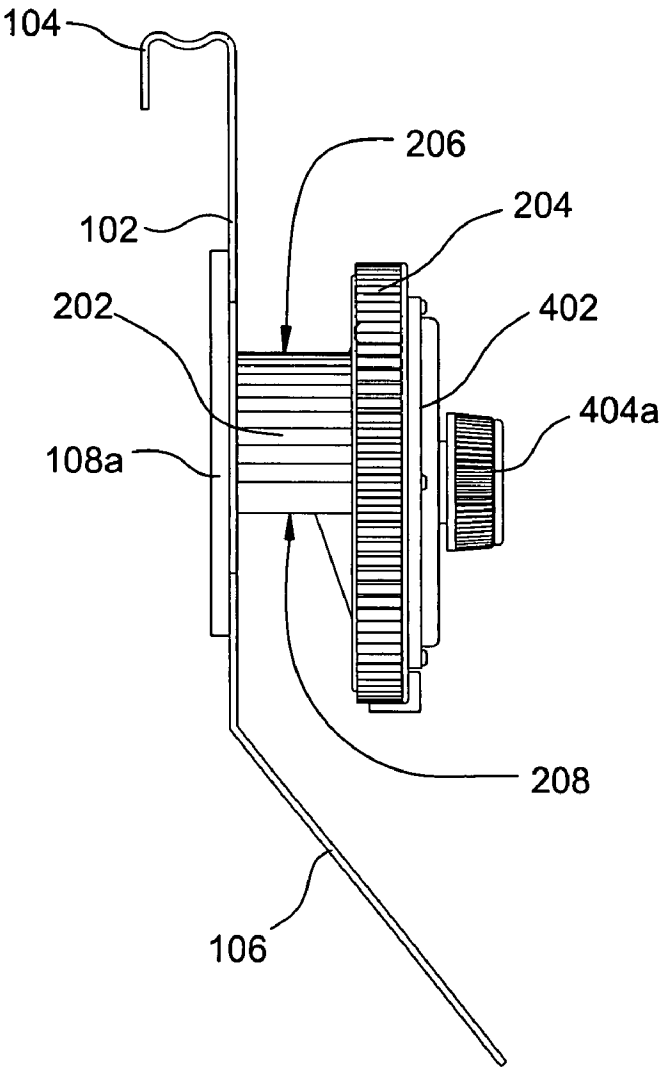
FIGS. 3A–3D are side views of the exemplary installation tool.

The body member 102, the siding-engagement member 104, and the cam segment 202 are arranged for enabling adjustment over a range of vertical overlap of the siding boards 20 and 30. The engaged top edge of the first board 20 is overlapped by a bottom edge of a second siding board 30 received between the body member 102 and the grip segment 204 (FIGS. 8 and 9). The overlap of the boards is adjusted by rotation of the cam member 200 among a plurality of rotational positions (some rotational positions illustrated in FIGS. 3B–3D) with the bottom edge of the second board 30 engaged against the eccentrically curved engagement portion 206 of the cam segment 202 (as in FIG. 8). In the examples shown in the Figures, the cam segment 202 is arranged so that any point of contact between the eccentrically curved engagement portion 206 and the bottom edge of board 30 is substantially aligned horizontally with the rotation axis (e.g. the horizontal displacement of the contact point relative to a vertical plane containing the rotation axis is less than about the radius of pin 300; any other suitable limit for this horizontal displacement may be employed). In this horizontally aligned arrangement, the minimum overlap distance of the range (labeled F in FIG. 3D) is substantially equal to the distance between the rotation axis and the engaged top edge 22 of the first board 20 (labeled G in FIG. 3D) minus the maximum radial distance (labeled E in FIGS. 3D and 4D) between the rotation axis and the eccentrically curved portion 206 of the cam segment 202. In this horizontally aligned arrangement, the maximum overlap distance of the range (labeled H in FIG. 3C) is substantially equal to the distance G between the rotation axis and the engaged top edge of the first board 20 minus the minimum radial distance (labeled A in FIGS. 3C and 4D) between the rotation axis and the eccentrically curved portion 206 of the cam segment 202. Rotation of the cam member 200 enables adjustment of the overlap of the boards 20 and 30 between these minimum and maximum overlap distances (note the variation among FIGS. 3B–3D). Substantial horizontal alignment of the contact point and the rotation axis reduces or substantially eliminates torque on the cam member arising from the supported weight of the second board. Such torque could cause unwanted rotation of the cam member 200 and misalignment of the board 30. Substantial horizontal alignment of the contact point and the rotation axis may be defined functionally: the limit for the horizontal displacement of the contact point may be determined by the supported weight of the board 30 and the torque necessary to cause unwanted rotation of cam member 200.

Figure 3A:
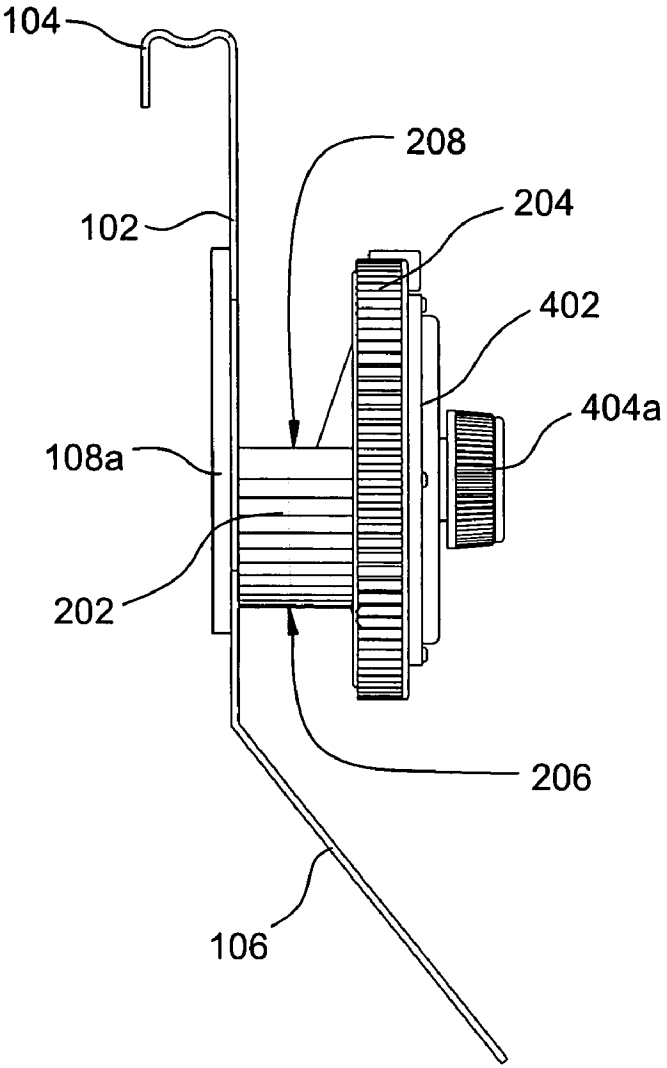
Figure 3D:
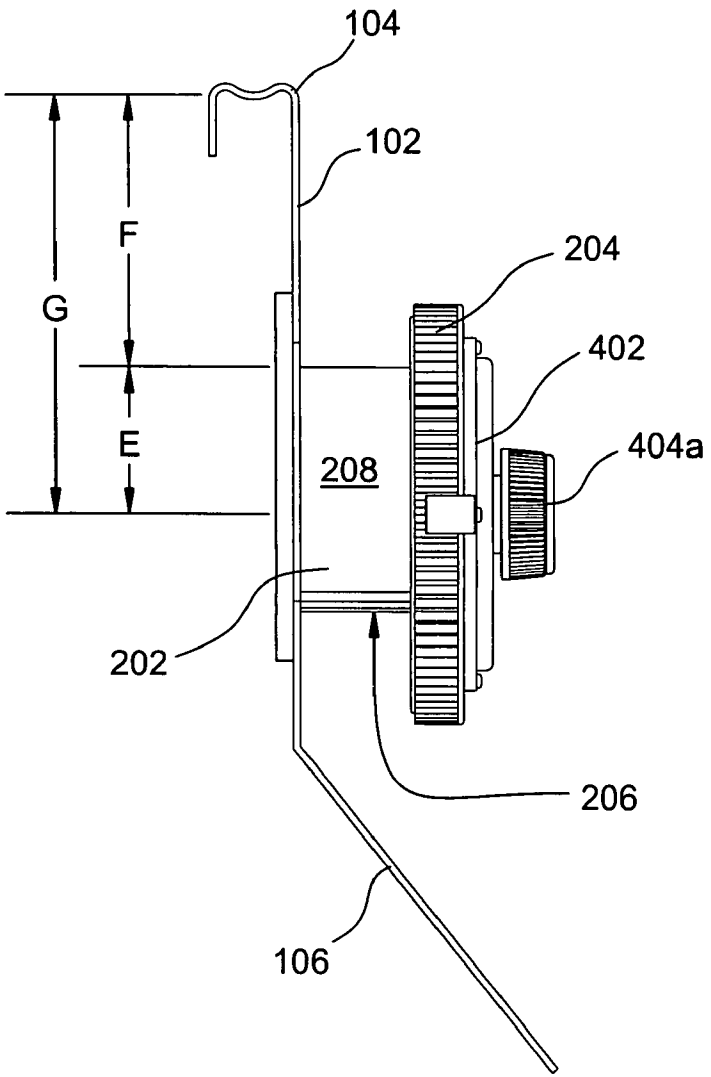
Figure 3C:
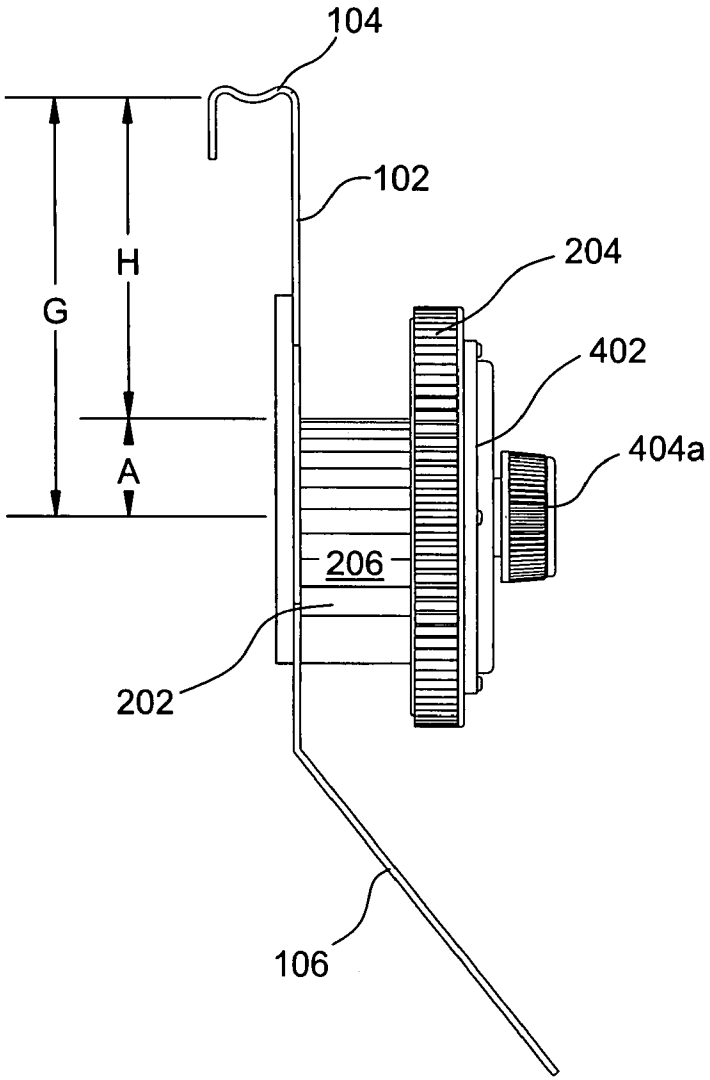

The body member 102, the siding-engagement member 104, and the cam segment 202 are also arranged for enabling disengagement of the cam segment 202 from the second board 30 by rotation of the cam member 200 so that the disengagement portion 208 of the cam segment faces upward toward the bottom edge 32 of the second board 30 (FIGS. 3A and 9). This enables the installation tool to be moved upward or tilted sideways to disengage the siding-engaging member 104 from the top edge of the first board 20. In the exemplary embodiments shown in the Figures, the disengagement portion 208 of the cam segment 202 is substantially flat. The minimum radial distance A between the rotation axis and the eccentrically curved engagement portion 206 is greater than or equal to the perpendicular distance (labeled B in FIG. 4D) between the rotation axis and the substantially flat disengagement portion 208 of the cam segment 202.

Any suitable means may be employed for rotatably engaging the cam member 200 with the body member 102, and for defining the rotation axis substantially perpendicular to the flattened body member. In the exemplary embodiments shown in the Figures, a pin 300 engaged at a first end thereof with a hole 108 in the body member 102 defines the rotation axis and serves to rotatably engage the cam member 200 with the body member 102. The body member 102 may include a plurality of holes 108 for engaging the first end of the pin 300. The holes 108 are positioned at differing vertical positions, thereby enabling selection of a desired vertical position for the adjustment range of the vertical overlap of the siding boards 20 and 30. Any other suitable means may be employed for selecting from among differing vertical positions a vertical position for the adjustment range of the vertical overlap of the siding boards 20 and 30.

It may be desirable for the vertical separations between adjacent holes 108 of the body member 102 (or between adjacent vertical positions otherwise selected for the adjustment ranges) to each be less than or about equal to a difference between the maximum radial distance (labeled E) and the minimum radial distance (labeled A) between the rotation axis and the eccentrically curved engagement portion 206 of the cam segment 202. In this way the ranges of the vertical overlap of the siding boards 20 and 30 provided by rotation of the cam member 200 at each of the different vertical positions substantially continuously cover a larger overall range of achievable siding board overlap. In one example, the centers of holes 108 may be separated by about 0.25 inches, while the difference between the minimum and maximum radial distances between the rotation axis and the eccentrically curved engagement portion 206 of the cam segment 202 may be about 0.25 inches or larger. Adjustment to the minimum overlap at one pin/hole position results in about the same overlap as adjustment to the maximum overlap at the next lower pin/hole position, resulting in substantially continuous adjustability over the combined ranges. Any other suitable distances or separations may be employed. Any desired number of holes, pin positions, or adjustment range positions may be employed; four such positions are shown in the Figures.

The installation apparatus may further comprise a mechanism or any other suitable means for substantially preventing unwanted rotation of the cam member 200 at a plurality of continuous or discrete rotational positions thereof. For example, the installation tool may further comprise a spring-biased detent mechanism arranged for retaining the cam member 200 at a selected one of a plurality of discrete rotational positions. The detent mechanism enables rotation of the cam member 200 among the plurality of rotational positions by sufficient torque applied by a user to the grip segment 204. Any other suitable means may be employed for retaining the cam member in a selected one of a plurality of discrete rotational positions and for enabling rotation of the cam member among the plurality of rotational positions by sufficient torque applied by a user to the grip segment. Alternatively, the installation tool may further comprise a locking mechanism or any other suitable locking means movable between an unlocked position and a locked position, with the locking mechanism substantially preventing in the locked position rotation of the cam member 200, and allowing in the unlocked position rotation of the cam member 200 among a plurality of continuous or discrete rotational positions. Examples of such locking means may include, but are not limited to: locking screws or fasteners, quick-release mechanisms (as used on bicycle axles, for example), clamps, friction or brake mechanisms, locking pins, and so on.

Figure 6C:
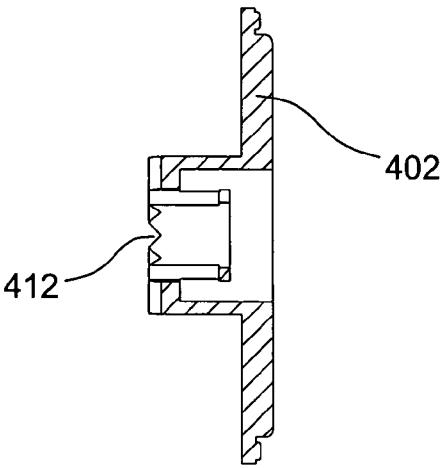
FIGS. 6A–6C are side, front, and cross-sectional views, respectively, of a cam-retaining member of the exemplary installation tool.
Figure 6A:
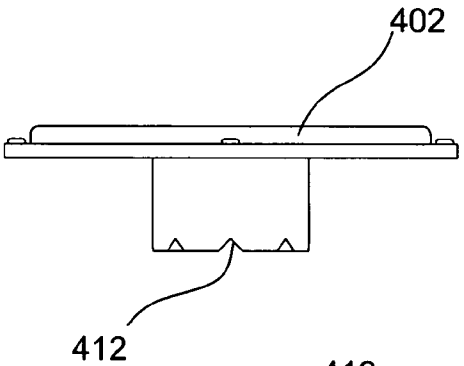
Figure 6B:
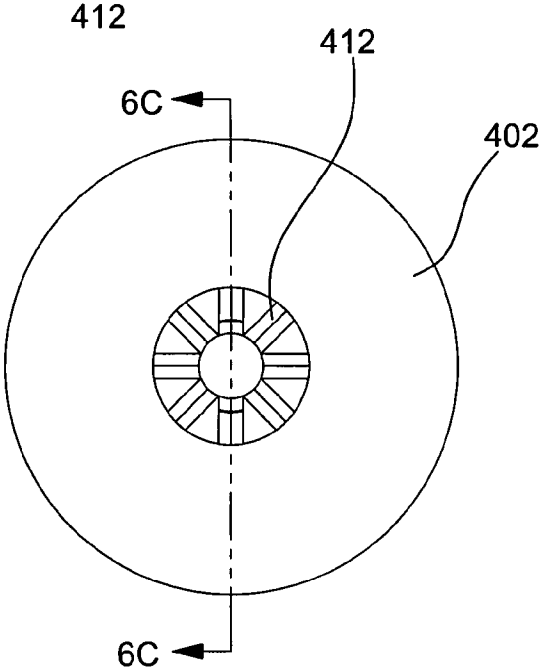

In an exemplary embodiment, the spring-biased detent mechanism 400 may comprise: the pin 300 substantially non-rotatably engaged at a first end thereof with one of the holes 108 in the body member 102; a cam-retaining member 402 positioned with the cam member 200 between the body member 102 and the cam-retaining member 400; and a spring member 404. In the example shown, pin 300 is non-rotatably engaged with one of holes 108 by flange 302 and retaining plate 108*a*; any other suitable means may be employed. The spring member 404 is engaged with the pin 300 (by threaded knob 404*a* engaged with threaded end 304 of pin 300 in the example shown; any other suitable means may be employed) and with the cam-retaining member 402 for biasing the cam-retaining member 402 against the cam member 200. The cam-retaining member 402 is substantially non-rotatably engaged with the pin 300 (by pin 406 in this example; any other suitable means may be employed) and is movable axially along the pin 300. The detent mechanism 400 further comprises a set of radial ridges 410 and a corresponding set of radial grooves 412. One of the sets (ridges 410 in the example shown) is formed on a surface of the cam member 200 facing the cam-retaining member 402 (FIGS. 4A–4B), while the other of the sets (grooves 412 in the example shown) is formed on a surface of the cam-retaining member 402 facing the cam member 200 (FIGS. 6A–6C). Engagement of the ridges 410 with the grooves 412 substantially prevents rotation of the cam member 200, while disengagement of the ridges 410 from the grooves 412 enables rotation of the cam member 200. Biasing of the cam-retaining member 402 against the cam member 200 by spring member 404 engages the ridges 410 with the grooves 412 and substantially prevents rotation of the cam member 200. Application of sufficient torque by the user to the grip segment 204 results in disengagement of the ridges 410 from the grooves 412 (by axial movement of the cam-retaining member 402 along the pin 300 against the tension of spring member 404) and thereby enables rotation of the cam member 200. Adjustment of the tension of spring member 404 (by threaded knob 404*b* on threads 304 in the example shown; any other suitable means may be employed) in turn adjusts the applied torque required for disengaging the ridges 410 from the grooves 412 and allowing rotation of the cam member 200.

A method for installing siding comprises: engaging a first siding installation tool with a top edge of a substantially horizontal installed first siding board; engaging a second siding installation tool with the top edge of the first board at a position horizontally displaced from the engaged first installation tool; positioning a second siding board with a bottom edge thereof received between the corresponding body members and grip segments of the installation tools, with the bottom edge against the corresponding eccentrically curved engagement portions of the corresponding cam segments of the installation tools (FIG. 8); adjusting vertical overlap of the engaged top edge of the first board by the received bottom edge of the second board by rotating the cam members of the installation tools; securing the second board to an installation surface; rotating the cam members of each of the installation tools so that corresponding disengagement portions of the cam segments face upward toward the bottom edge of the second board, thereby disengaging the cam segments from the second board (FIG. 9); and disengaging and removing the first and second installation tools from the first board.

For purposes of the present disclosure and appended claims, the conjunction "or" is to be construed inclusively (e.g., "a dog or a cat" would be interpreted as "a dog, or a cat, or both"; e.g., "a dog, a cat, or a mouse" would be interpreted as "a dog, or a cat, or a mouse, or any two, or all three"), unless: i) it is explicitly stated otherwise, e.g., by use of "either . . . or", "only one of . . . ", or similar language; or ii) two or more of the listed alternatives are mutually exclusive within the particular context, in which case "or" would encompass only those combinations involving non-mutually-exclusive alternatives. It is intended that equivalents of the disclosed exemplary embodiments and methods shall fall within the scope of the present disclosure and/or appended claims. It is intended that the disclosed exemplary embodiments and methods, and equivalents thereof, may be modified while remaining within the scope of the present disclosure or appended claims.

What is claimed is:

1. An apparatus for installing siding boards, comprising:

a flattened central body member;

a siding-engagement member at a first end of the body member; and a cam member rotatably engaged with the body member so as to rotate about a rotation axis substantially perpendicular to the flattened body member, the cam member comprising a grip segment and a cam segment, the cam segment being positioned between the body member and the grip segment, wherein:

the body member and the siding-engagement member are arranged for engaging a top edge of a substantially horizontal installed first siding board with the body member against a front surface of the first board and with the rotation axis substantially perpendicular to the front surface of the first board;

the cam segment has a cross-sectional profile comprising an eccentrically curved engagement portion and a disengagement portion;

the cam segment is sufficiently thick so as to enable a siding board to be received between the body member and the grip segment with an edge thereof against the cam segment;

the grip segment extends radially from the rotation axis by a distance exceeding a maximum radial distance between the rotation axis and the eccentrically curved engagement portion of the cam segment so as to retain a siding board received between the body member and the grip segment;

the body member, the siding-engagement member, and the cam segment are arranged for enabling adjustment over a range of vertical overlap of the engaged top edge of the first board by a bottom edge of a second siding board received between the body member and the grip segment by rotation of the cam member among a plurality of rotational positions with the bottom edge of the second board engaged against the eccentrically curved engagement portion of the cam segment; and the body member, the siding-engagement member, and the cam segment are arranged for enabling disengagement of the cam segment from the second board by rotation of the cam member so that the disengagement portion of the cam segment faces upward toward the bottom edge of the second board.

2. The apparatus of claim 1, wherein the disengagement portion of the cam segment is substantially flat, and a minimum radial distance between the rotation axis and the eccentrically curved engagement portion is greater than or equal to a perpendicular distance between the rotation axis and the substantially flat disengagement portion of the cam segment.

3. The apparatus of claim 1, wherein the cam segment is arranged so that a point of contact between the eccentrically curved engagement portion of the cam segment and the bottom edge of the second board is substantially aligned horizontally with the rotation axis.

4. The apparatus of claim 1, further comprising a handle member at a second end of the body member.

5. The apparatus of claim 1, wherein the siding-engagement member comprises a hook formed at the first end of the body member, the hook comprising a J-shaped hook or an L-shaped hook.

6. The apparatus of claim 1, wherein:

the siding-engagement member comprises a J-shaped hook; and a downward-projecting portion of the J-shaped hook comprises an oblique isosceles triangular plate for enabling disengagement of the apparatus from the top edge of the first board by tilting the body member sideways.

7. The apparatus of claim 1, further comprising a pin engaged at a first end thereof with a hole in the body member, the pin defining the rotation axis and serving to rotatably engage the cam member with the body member.

8. The apparatus of claim 7, wherein the body member includes a plurality of holes for engaging the first end of the pin, the holes being positioned at differing vertical positions, thereby enabling selection from among differing vertical positions a vertical position for the adjustment range of the vertical overlap of the first board by the second board.

9. The apparatus of claim 8, wherein vertical separations between adjacent holes of the body member are each less than a difference between the maximum radial distance and the minimum radial distance between the rotation axis and the eccentrically curved engagement portion of the cam segment.

10. The apparatus of claim 1, further comprising a mechanism for substantially preventing unwanted rotation of the cam member at a plurality of rotational positions thereof.

11. The apparatus of claim 10, wherein the mechanism comprises a spring-biased detent mechanism arranged for retaining the cam member at a selected one of a plurality of discrete rotational positions, the detent mechanism enabling rotation of the cam member among the plurality of rotational positions by sufficient torque applied by a user to the grip segment.

12. The apparatus of claim 11, wherein the spring-biased detent mechanism comprises:

a pin substantially non-rotatably engaged at a first end thereof with a hole in the body member, the pin defining the rotation axis and serving to rotatably engage the cam member with the body member;

a cam-retaining member substantially non-rotatably engaged with the pin and positioned with the cam member between the body member and the cam-retaining member, the cam-retaining member being movable axially along the pin;

a spring member engaged with the pin and with the cam-retaining member for biasing the cam-retaining member against the cam member; and a set of radial ridges and a corresponding set of radial grooves, one of the sets being formed on a surface of the cam member facing the cam-retaining member and the other of the sets being formed on a surface of the cam-retaining member facing the cam member, engagement of the ridges with the grooves substantially preventing rotation of the cam member, disengagement of the ridges from the grooves enabling rotation of the cam member, wherein:

biasing of the cam-retaining member against the cam member engages the ridges with the grooves; and the sufficient torque applied to the grip segment by the user results in disengagement of the ridges from the grooves and thereby enables rotation of the cam member.

13. The apparatus of claim 10, wherein the mechanism comprises a locking mechanism movable between an unlocked position and a locked position, the locking mechanism substantially preventing rotation of the cam member in the locked position and allowing rotation of the cam member in the unlocked position.

14. An apparatus for installing siding boards, comprising:

a flattened central body member;

a cam member comprising a grip segment and a cam segment, the cam segment being positioned between the body member and the grip segment;

means for rotatably engaging the cam member with the body member, the cam member rotating about a rotation axis substantially perpendicular to the flattened body member;

means for engaging a first end of the body member with a top edge of a substantially horizontal installed first siding board with the body member against a front surface of the first board and with the rotation axis substantially perpendicular to the front surface of the first board;

means for receiving a siding board between the body member and the grip segment with an edge thereof against the cam segment;

means for retaining a siding board received between the body member and the grip segment, wherein:

the cam segment has a cross-sectional profile comprising an eccentrically curved engagement portion and a disengagement portion;

the body member, the siding-engagement means, and the cam segment are arranged for enabling adjustment over a range of vertical overlap of the engaged top edge of the first board by a bottom edge of a second siding board received between the body member and the grip segment by rotation of the cam member among a plurality of rotational positions with the bottom edge of the second board engaged against the eccentrically curved engagement portion of the cam segment; and the body member, the siding-engagement means, and the cam segment are arranged for enabling disengagement of the cam segment from the second board by rotation of the cam member so that the disengagement portion of the cam segment faces upward toward the bottom edge of the second board.

15. The apparatus of claim 14, wherein the disengagement portion of the cam segment is substantially flat.

16. The apparatus of claim 14, wherein the cam segment is arranged so that a point of contact between the eccentrically curved engagement portion of the cam segment and the bottom edge of the second board is substantially aligned horizontally with the rotation axis.

17. The apparatus of claim 14, further comprising handle means at a second end of the body member.

18. The apparatus of claim 14, further comprising means for enabling disengagement of the apparatus from the top edge of the first board by tilting the body member sideways.

19. The apparatus of claim 14, further comprising means for selecting from among differing vertical positions a vertical position for the adjustment range of the vertical overlap of the first board by the second board.

20. The apparatus of claim 19, wherein differences between adjacent ones of the differing vertical positions are each less than a difference between the maximum radial distance and the minimum radial distance between the rotation axis and the eccentrically curved engagement portion of the cam segment.

21. The apparatus of claim 14, further comprising means for substantially preventing unwanted rotation of the cam member.

22. The apparatus of claim 14, further comprising means for retaining the cam member in a selected one of a plurality of rotational positions and for enabling rotation of the cam member among the plurality of rotational positions by sufficient torque applied by a user to the grip segment.

23. The apparatus of claim 14, further comprising locking means for substantially preventing rotation of the cam member in a locked position and for allowing rotation of the cam member in an unlocked position.

24. A method for installing siding, comprising:

engaging a first siding installation tool with a top edge of a substantially horizontal installed first siding board;

engaging a second siding installation tool with the top edge of the first board at a position horizontally displaced from the engaged first installation tool;

positioning a second siding board with a bottom edge thereof received between a body member of the first installation tool and a grip segment of a cam member of the first installation tool and with the bottom edge against an eccentrically curved engagement portion of a cam segment of the cam member of the first installation tool;

positioning the second siding board with the bottom edge received between a body member of the second installation tool and a grip segment of a cam member of the second installation tool and with the bottom edge against an eccentrically curved engagement portion of a cam segment of the cam member of the second installation tool;

adjusting a first vertical overlap of the engaged top edge of the first board by the received bottom edge of the second board by rotating the cam member of the first installation tool;

adjusting a second vertical overlap of the engaged top edge of the first board by the received bottom edge of the second board by rotating the cam member of the second installation tool;

securing the second board to an installation surface;

rotating the cam members of each of the installation tools so that corresponding disengagement portions of the cam segments face upward toward the bottom edge of the second board, thereby disengaging the cam segments from the second board; and disengaging and removing the first and second installation tools from the first board, wherein the first and second installation tools each comprise:

a flattened central body member;

a siding-engagement member at a first end of the body member; and the cam member rotatably engaged with the body member so as to rotate about a rotation axis substantially perpendicular to the flattened body member, the cam member comprising the grip segment and the cam segment, the cam segment being positioned between the body member and the grip segment, wherein:

the body member and the siding-engagement member are arranged for engaging the top edge of the first board with the body member against a front surface of the first board and with the rotation axis substantially perpendicular to the front surface of the first board;

the cam segment has a cross-sectional profile comprising the disengagement portion and the eccentrically curved engagement portion;

the cam segment is sufficiently thick so as to enable a siding board to be received between the body member and the grip segment with the edge thereof against the cam segment;

the grip segment extends radially from the rotation axis by a distance exceeding a maximum radial distance between the rotation axis and the eccentrically curved engagement portion of the cam segment so as to retain a siding board received between the body member and the grip segment;

the body member, the siding-engagement member, and the cam segment are arranged for enabling adjustment over a range of vertical overlap of the engaged top edge of the first board by a bottom edge of a second siding board received between the body member and the grip segment by rotation of the cam member among a plurality of rotational positions with the bottom edge of the second board engaged against the eccentrically curved engagement portion of the cam segment; and the body member, the siding-engagement member, and the cam segment are arranged for enabling disengagement of the cam segment from the second board by rotation of the cam member so that the disengagement portion of the cam segment faces upward toward the bottom edge of the second board.

* * * * *